United States Patent [19]

Brzozowski

[11] Patent Number: 4,930,318

[45] Date of Patent: Jun. 5, 1990

[54] CRYOCOOLER COLD HEAD INTERFACE RECEPTACLE

[75] Inventor: Steven J. Brzozowski, Scotia, N.Y.

[73] Assignee: General Electric Company, Schenectady, N.Y.

[21] Appl. No.: 348,322

[22] Filed: May 5, 1989

Related U.S. Application Data

[63] Continuation of Ser. No. 215,114, Jul. 5, 1988, abandoned.

[51] Int. Cl.[5] ..... F25B 19/00

[52] U.S. Cl. ..... 62/51.1; 62/295; 250/352; 505/892

[58] Field of Search ..... 62/295, 51.1; 250/352; 505/892

[56] References Cited

U.S. PATENT DOCUMENTS

| | | | |
|---|---|---|---|
| 4,241,592 | 12/1980 | Tapphorn | 62/51.1 |
| 4,474,036 | 10/1984 | Ball et al. | 62/51.1 |
| 4,535,595 | 8/1985 | Keller et al. | 62/3 |
| 4,537,033 | 8/1985 | Kamil | 62/3 |
| 4,565,925 | 1/1986 | Anderson | 62/51.1 |
| 4,696,169 | 9/1987 | Niemann et al. | 62/51.1 |

OTHER PUBLICATIONS

CL Partain, "NMR Imaging", 1983, Chap. 9, pp. 115–127, published by W. B. Saunders Co., Chpt. by C. E. Roos et al., See p. 128, FIGS. 9–10.

*Primary Examiner*—Ronald C. Capossela

*Attorney, Agent, or Firm*—William H. Steinberg; James C. Davis, Jr.; Paul R. Webb, II

[57] ABSTRACT

Demountable cryocoller cold heads must make reliable contacts having low thermal resistance at cryogenic temperatures for cooling such devices as radiation shields used in superconducting magnets. Cryostat vacuum and a bellows is utilized in order to engage the cold head second stage interface, while the first stage interface is independently engaged by means of a bolted flange and a bellows. A soft metal such as indium is employed at the contact surfaces of the heat stations.

3 Claims, 3 Drawing Sheets

CRYOCOOLER COLD HEAD INTERFACE RECEPTACLE

This application is a continuation of application Ser. No. 215,114, filed 7/5/88 now abandoned.

CROSS REFERENCE TO RELATED APPLICATIONS

The present invention is related to copending applications Superconductor Cryogenic Current Lead, Ser. No. 07/215,113; Superconductive Magnetic Resonance Magnet Without Cryogens, Ser. No. 07/215,765; Efficient Thermal Joints For Connecting Current Leads to a Cryocooler, Ser. No. 07/215,131; Low Thermal Conductive for a Radiation Shield in a MR Magnet, Ser. No. 07/215,111; Cable Suspension System for Cylindrical Cryogenic Vessels, Ser. No. and 07/215,477; and A Superconductive Quench Protected Magnet Coil, Ser. No. 07/215,479.

BACKGROUND OF THE INVENTION

The present invention relates to a direct contact thermal interface for demountably interconnecting a multistage cryocooler and a magnetic resonance magnet.

Cryocoolers using the Gifford-McMahon cycle, for example, can achieve low temperatures at their heat stations for removing heat from the interior of superconducting magnets. The heat stations in a two stage cryocooler are located at the end of the first and second stages of the cold head portion of the cryocooler. To connect the cryocooler heat stations to surfaces, such as radiation shields, from which heat is to be removed, high contact forces are needed as well as soft metal interfaces in order to achieve low thermal resistances. Since the cryocooler is removable, heavy frost can accumulate at the interface when the cryocooler is removed for servicing. Re-establishing the connection in the presence of heavy frost can be difficult.

Differential expansion or contraction between a two stage cryocooler and the interface receptacle can also interfere with the formation of thermally efficient contact resistances.

It is an object of the present invention to provide a cryocooler cold head interface receptacle for making reliable contacts with low thermal resistance at cryogenic temperatures.

It is another object of the present invention to independently control contact forces at each stage of the cryocooler cold head.

SUMMARY OF THE INVENTION

In one aspect of the present invention an MR magnet cooled by a multistage cryocooler is provided having a cryostat defining an opening and having platform means situated inside the cryostat. A first sleeve with a closed end and an open end, has the closed end extending inside the cryostat and is supported by the platform means. The first sleeve includes a first stage heat exchanger contact means secured inside the sleeve between the sleeve ends. A portion of the sleeve wall extending from the first stage heat exchanger contact means to the closed end is axially flexible. A second sleeve surrounds the first sleeve with one open end airtightly surrounding the perimeter of the cryostat opening. The walls of the second sleeve are axially flexible. A first flange with a central aperture airtightly closes the annulus formed between the first and second sleeves with the first flange central aperture and the open end of the inner sleeve aligned with one another. The inner sleeve, outer sleeve and the first flange, airtightly seal the cryostat opening. A second flange with a central aperture is airtightly and axially adjustably secured relative to the second flange. The first flange is adapted to be secured to the cryocooler with the cryocooler cold end situated in the inner sleeve. When cryostat and inner sleeve are evacuated pressure is exerted between the second stage of the cryocooler and the bottom of the inner sleeve forming a low resistance thermal joint. Adjusting the axial position of the first flange relative to the second flange to elongate the axially flexible portion of the inner sleeve increases the force between the first stage heat station contact means and the first stage of the cryocooler making a thermally efficient joint.

BRIEF DESCRIPTION OF THE DRAWING

The subject matter which is regarded as the invention is particularly pointed out and distinctly claimed in the concluding portion of the specification. The invention, however, both as to organization and method of practice, together with further objects and advantages thereof, may best be understood by reference to the following description taken in conjunction with the accompanying drawing figures in which:

FIGS. 1A and B show a partial side view of a typical cryocooler within an interface receptacle in accordance with the present invention. The side view is split approximately along the center line of the cryocooler cold head to show on the right FIG. 1A and on the left FIG. 1B. FIG. 1B shows the cryocooler completely engaged with the heat stations of the interface and FIG. 1A shows the cryocooler before final engagement of the interface receptacle with the cryocooler stages.

DETAILED DESCRIPTION OF THE INVENTION

Figures 1A, 1B:
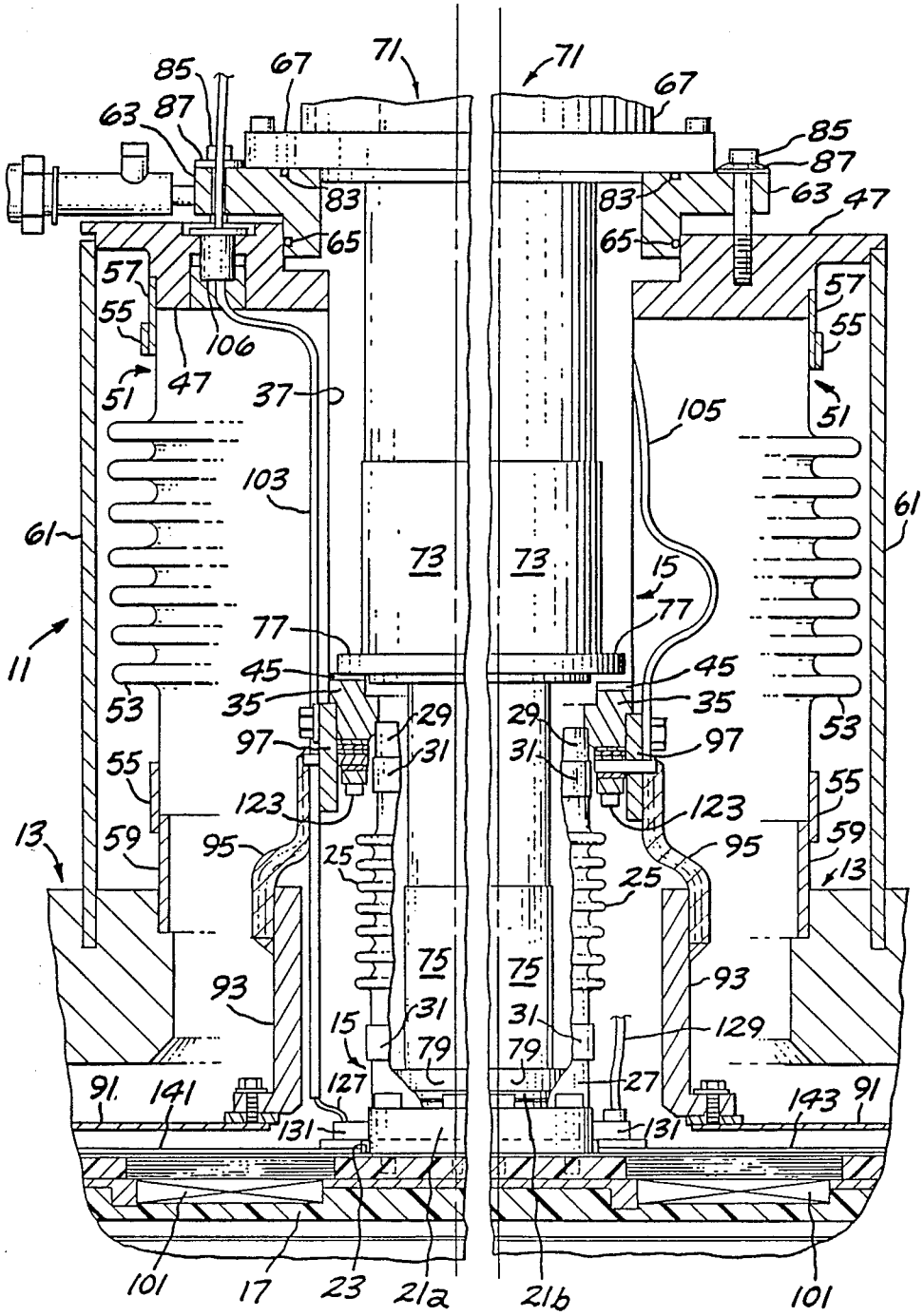
Figure 2:
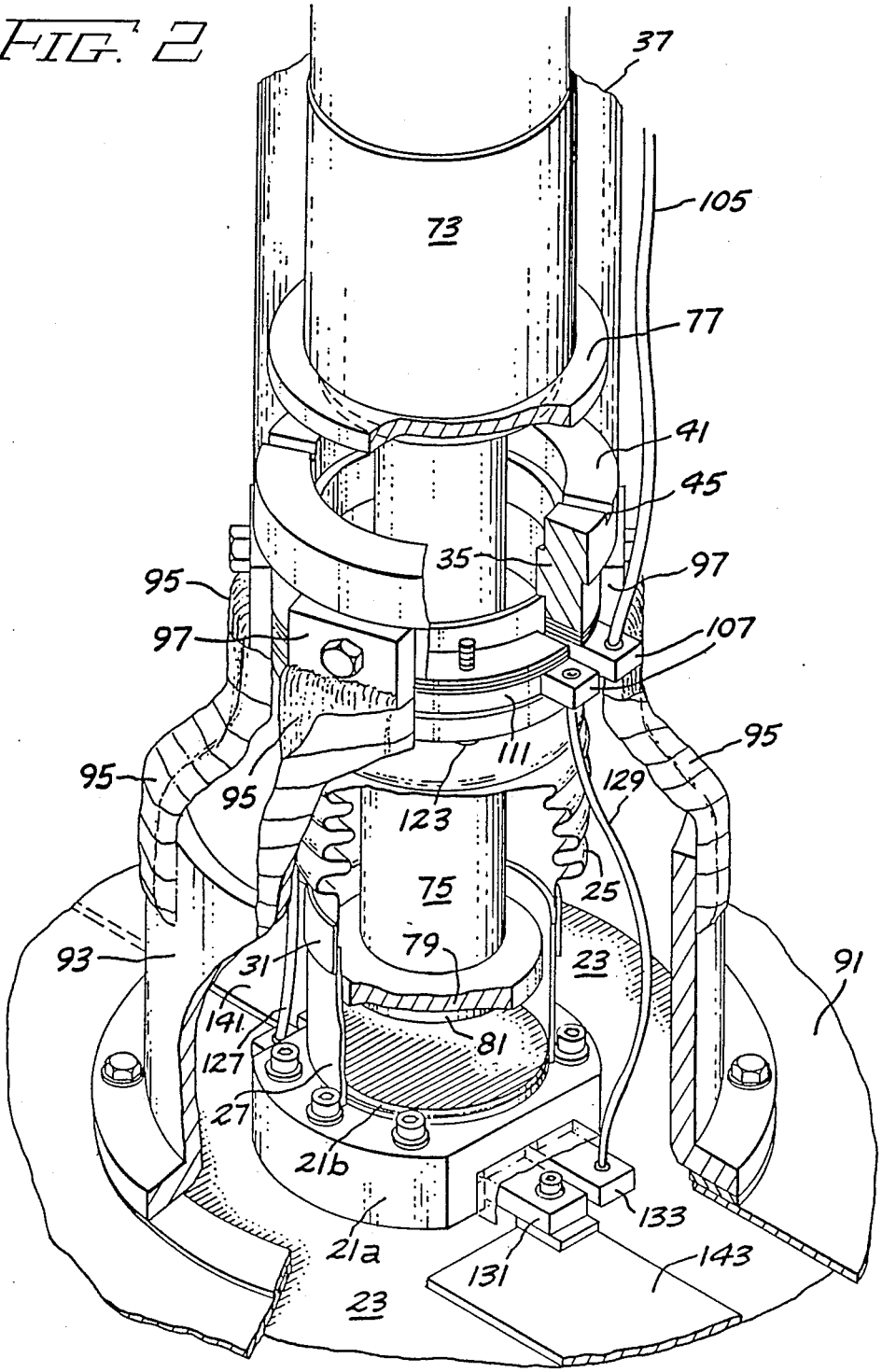
FIG. 2 shows a partially cutaway isometric view of the interior portion of the cryocooler interface receptacle with the cryocooler cold head shown partially withdrawn.

Referring now to the drawing wherein like numerals indicate like elements throughout and particularly FIGS. 1A and B and FIG. 2, a cryocooler cold head receptacle 11 is shown attached to a cryostat 13. The receptacle comprises an inner sleeve 15 which is closed at one end. The closed end extends through an opening in the cryostat and rests on a support in the cryostat In the present embodiment, the support comprises a copper enclosed winding form 17. The winding form is supported from the outer cryostat housing by a suspension (not shown). The inner sleeve 15 is fabricated in several sections The closed end comprises a single piece of copper having a first and second diameter cylinders 21*a* and 21*b*, respectively, each with its center lying on the same axial centerline. The smaller diameter portion 21*a* of the cylinder is airtightly secured to the sleeve 15. In the present embodiment the copper cylinder is oven brazed in a hydrogen atmosphere to one end of the stainless steel sleeve 15 to form an airtight connection. The larger diameter cylinder 21*a* is bolted through the copper shield 23 of the winding form 17. To provide axial flexibility to the sleeve 15, a stainless steel bellows section 25 is joined between section 27 and section 29 of the inner sleeve by means of stainless steel bands 31 which are welded in place over the ends of the bellows 25 and the ends of the two sections 27 and 29. Section 29 is brazed to the inner perimeter of a copper ring shaped first stage heat exchanger 35 which forms a portion of the sleeve wall. The exterior of the ring 35 has six equally spaced flats. The upper portion of the sleeve 37 is joined to the outer diameter of the ring 35 creating a circular face 41 inside the sleeve visible in FIG. 2. The circular face has two slots 45 to allow flow communication between the upper and lower portions of the inner sleeve 15. The upper portion of the sleeve 37 terminates in the inner perimeter of a first stainless steel flange 47 having a central aperture.

An outer sleeve 51 having an axially flexible section shown as a stainless steel bellows 53, is connected by welded bands 55 to stainless steel sleeve sections 57 and 59 which are secured by welding to the first flange 47 and the outer perimeter of the cryostat housing 13. The outer 51 and inner sleeves 15 together with the first flange 47 make an airtight seal of the cryostat opening. To limit travel of the first flange 47 towards the cryostat 13 when the cryostat is evacuated, a split collar 61 fits in a groove in the cryostat and engages the periphery of the first flange 47 when the sleeve compresses axially towards the cryostat. The split collar 61 is shown surrounding the outer sleeve 51 but can alternatively be positioned between the inner and outer sleeves 51 and 15, respectively.

A second flange 63 having a central aperture is situated inside the aperture of the first flange 47 with an "O" ring 65 allowing an airtight axially sliding fit. A flange 67 on cryocooler 71 is secured to the second flange 63 with the cold end of the cryocooler including the two cooling stages 73 and 75 extending into the inner sleeve 15. The two stages operate at two different temperatures below room temperature with the second stage 75 being colder than the first stage 73. The exact temperature at the stages depend upon the heat load imposed, but the heat stations typically operate at 50K and 1OK, respectively. The two stages 73 and 75 of the cryocooler cold end each have a generally cylindrical shape and lie along the same axial axis. The second stage 75 has a smaller diameter than the first stage and extends therefrom first. The first stage 73 terminates in a disk shaped heat exchanger 77 having a central aperture through which the second stage extends. The second stage terminates in a disk shaped heat exchanger 79. The second stage end of the cryocooler contacts the copper cylinder 216 which closes off the end of the inner sleeve 15. A thin sheet 81 of indium assures good thermal contact between disc 79 and cylinder 216.

An "O" ring 83 is provided between the cryocooler flange 63 and the second flange 67 to assure a hermetic seal so that the inner sleeve 15 can be evacuated when the cryocooler 71 is in place. Adjustment means are provided to move the second flange axially relative to the first flange. In the present embodiment a ring of bolts 85 with Belleville washers 87 are shown joining the first and second flanges 63 and 47. The washers 87 are selected to flatten at a predetermined pressure. Tightening the bolts 85 until the washers 87 flatten exerts a predetermined force between the flanges. Alternatively, hydraulic clamp means (not shown) can be used to move the flanges axially relative to one another with a predetermined fluid pressure in the hydraulic line resulting in a predetermined force being exerted.

With the first flange 47 contacting the split ring 61 due to the evacuation of the cryostat 13, and the cryocooler 71 bolted to the second flange 63, the length of the inner sleeve 15 and the cold end of the cryocooler are such that the distance the second flange 63 can move towards the first flange 47 is greater than the space between the first stage heat exchanger 77 of the cryocooler and the surface on the ring 41 against which it seats.

In order to remove heat from shield 91 which is spaced away from coil form 17 and encloses it, in cryostat, a collar 93 of low emissivity material such as copper extends from the shield and surrounds the second stage portion of the inner sleeve 15 which encloses heat station 75 of the cryocooler reducing radiation losses between the 1OK cooled surfaces and the cryostat 13 housing 13. The collar 93 is affixed to ring 35, which operates as a first stage interface heat exchanger, by six pieces of copper braid 95 circumferentially spaced about the collar and welded thereto. The other ends of each of the braids extend to separate blocks 97 to which they are welded. The blocks are bolted to the flats on the perimeter of heat exchanger ring 35. The braid 95 permits movement between the inner sleeve 15 and the collar 93 which occurs due to thermal contraction and due to loosening and tightening of bolts 85. Heat transfer between the second stage cryocooler heat station and the shield 23 directly surrounding the coil form having magnet windings 101 is accomplished by copper cylinder 219 being directly bolted to the copper shield 23. The cylinder **21*b* which closes the end of the inner sleeve is formed from the same piece of copper as the portion which is bolted to the shield 21*a*. Thin indium sheet 81 visible in FIG. 2 is situated between the end of the cryocooler second stage heat station and the end of the cylinder 21*b*** assures good heat transfer.

Figure 3:
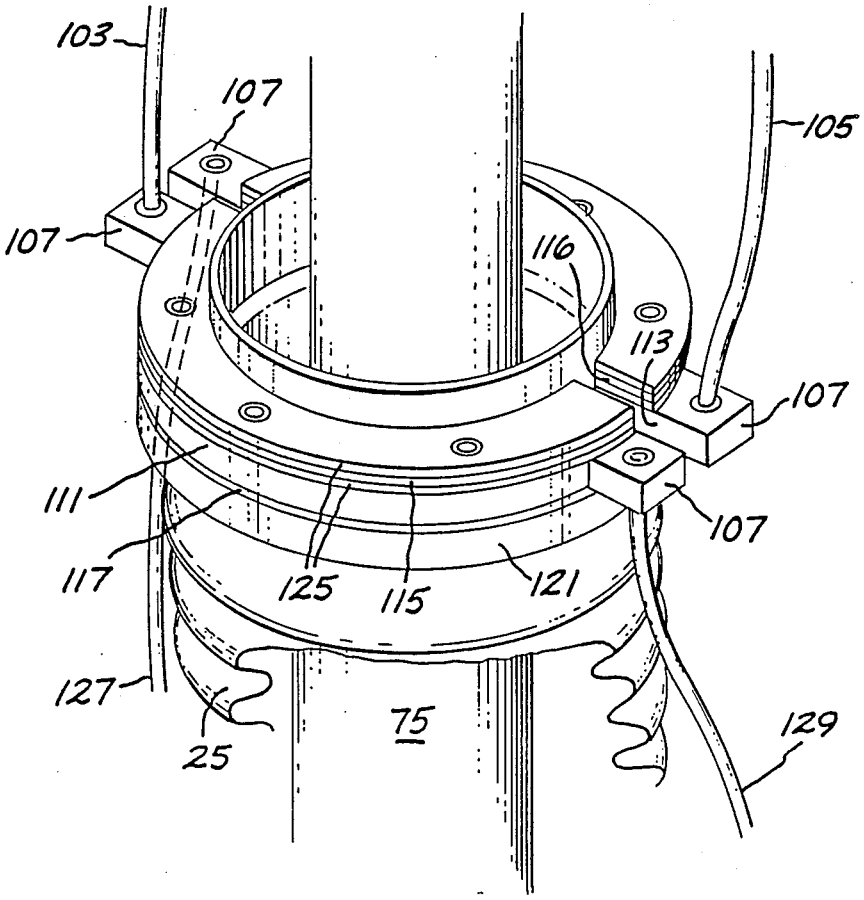
FIG. 3 shows an isometric view of the bus bar at the first stage heat exchanger in the inner sleeve of the cryocooler interface.

Permanently attached resistive leads 103 and 105 extend from the outside of the interface through insulated fittings 106 on the first flange to the interior of the second sleeve 51. The penetration is made airtight. The incoming leads are affixed to 107 extending from tabs on two semicircular copper buses 111 and 113, most easily seen in FIGS. 2 and 3. Tabs 107 extend radially from either end of each of the semicircular buses. The semicircular buses 111 and 113 are bolted to the bottom of the heat exchanger ring 35 together with electrical insulators 115 and 116 separating the copper buses 111 and 113 and the ring, another electrical insulator 117 and a stainless steel ring 121 spreading the load of bolts 123. A layer of indium 125 is situated on either side of insulator 115 to assure a good thermal joint. Insulator 115 comprises alumina or beryllia ceramic. Beryllia is preferred because of its greater heat conductivity. The insulator 115 can be used without any metallization. Alternatively, if the ceramic is metallized with copper or nickel on both sides, the metallized ceramic can be soldered between copper ring 25 and bus bars using a solder with a modulus of elasticity such as indium solder and a pressure joint is not required. The metallization can be applied by vapor deposition. The thickness of the metallization can be 1 mil or less. The ceramic separates the copper or nickel on both sides maintaining electrical isolation between the two surfaces. Typical thicknesses are about 30 mils for the ceramic and 5 mils for the directly bonded metal.

In the embodiment shown, the ceramic is not soldered, and bolts 123 extend through insulating sleeves 127 to avoid electrically short circuiting the two semicircular copper buses together. The bolts are tightened to provide at least 300 psi between layers so that the indium layers 125 flow to assure good thermal conductivity between adjacent faces.

A second pair of leads 127 and 129 are soldered to the two remaining tabs 107 on each of the semicircular bus bars so that lead 127 is soldered to the same bus bar as lead 103 and lead 129 is soldered to the same bus bar as lead 105. Leads 127 and 129 then connected to bus bars 131 and 133, respectively, which are situated in a slot in the cylinder 21*a*. The bus bars are bolted up into cylinder 21*a*. A ceramic insulator comprising beryllia or alumina ceramic with two thin sheets of indium on either side are placed between the bus bar and the cylinder. A stainless steel bar on each bus bar spreads the load of the bolts. The bolts create at least 300 psi between layers to allow the indium to flow to create a good thermal joint. The bus bars are separated from one another a distance sufficient to provide a 250 volt dielectric strength. The bus bars 131 and 133 are joined to the copper bus bars 141 and 143 on the magnet by a bolted joint.

At 77K the thermal conductance of using joints of beryllia and alumina have been measured to be as good as 5 $W/cm^2-K$. Dielectric strength for these ceramics is better than the 250 volts required. In the first stage interface in one magnet design, the high temperature lead sections will expel 2.3 watts into the first stage of the cooler. The area available for heat transfer here is 12 square cm. The equation for temperature rise across a joint with thermal conductance h and area A transferring heat Q is $\Delta T=Q/(hA)$. THerefore, in order to maintain the temperature difference between the bus bar and the cooler less than 0.1K, a thermal conductance of at least 2 $W/cm^2-K$ is required. The proposed joint design fulfills this requirement.

The same magnet design has a heat input to the magnet independent of the current leads of 0.4 W, and an area available for heat transfer from the magnet to the second stage of the cooler of 35 square cm. For a dismountable thermal joint, the best thermal conductance available at 77 K is about 1.8 $W/cm^2-K$. Therefore, assuming this value to be temperature independent, the temperature difference across this joint is 0.0063 K. Now the heat leak down each resistive current lead is 0.31 watts. With the ceramic join thermal conductance of 5 $W/cm^2-K$, only 9.8 square cm. of area will maintain the temperature rise across this joint at less than 0.0063 K. This much area is available, so the heat will indeed travel into the cooler rather than the magnet.

The interface can be installed in the cryostat by first welding the outer sleeve 51 to the cryostat opening with the outer sleeve welded to flange 47. The inner sleeve 15 is installed in the opening by first bolting the copper cylinder 21*a* to the magnet winding form 17 with the bus bars 131 and 133 already in place. Leads 127 and 129 are soldered in place. The shield collar 93 with the braided sections 95 welded to the collar and blocks 97 is bolted to shield 91. Leads 103 and 105 which through flange 47 are soldered to tabs 107.

In operation, the cryostat 13 is evacuated causing the outer sleeve 51 to contract axially with the first flange 47 supported by the split collar 61. The cold end of the cryocooler is inserted into the inner sleeve 15 and bolted to the second flange 63. The inner sleeve 15 is evacuated creating an atmospheric pneumatic force proportional to the diameter of "O" ring 65 exerted on the second stage cryocooler heat station 75 and the end of the copper cylinder 21*b*. When "O" ring 65 has a 5 inch diameter, for example, the resulting pressure is 134 psi between th second stage cryocooler heat station and copper cylinder 21*b*.

The relative position of the parts at this stage of assembly are as shown in FIG. 1A. Additional force is next applied to the interface by tightening bolts 85 until flange 47 is lifted from the split collar 61 transferring the pneumatic force of the atmosphere pressure on the outer bellows 53 to a downward force on the second stage cryocooler heat station which results in a total interface pressure of 468 psi when the outer sleeve has an effective diameter of 9⅜ inches.

Further tightening of the bolts 85 continues to lift the 50K heat station 35 so that the pressure at the interface between the first stage cryocooler heat station 77 and heat station 35 is increased to at least 300 psi by further deflecting the Belleville washers 87. However, the 1OK interface is relatively unaffected due to the low spring constant of the bellows 25 over the distances involved.

It will be recognized that the interface pressures may be adjusted by varying the diameter of the outer bellows 53 or "O" ring 65 and by varying spring constants of either or both bellows 25 and 53.

The foregoing has described a cryocooler cold head interface receptacle which makes reliable contacts with low thermal resistance at cryogenic temperatures. Also, the contact forces at each stage of the cryocooler interface can be independently controlled.

While the invention has been particularly shown and described with reference to an embodiment thereof, it will be understood by those skilled in the art that various changes in form and detail may be made without departing from the spirit and scope of the invention.

What is claimed is:

1. Superconductor magnet cooled by a multistage cyrocooler comprising;

a cryostat defining an opening;

a platform means situated inside the cryostat;

a first sleeve having a closed end and an open end, the closed end extending inside said cryostat with said closed end supported by said platform means, said sleeve having a first stage heat station contact means secured inside said sleeve, the portion of said sleeve extending between the heat station means and the closed end being axially flexible;

a second sleeve surrounding siad first sleeve, one open end of said second sleeve airtightly surrounding the perimeter of the cryostat opening, said second sleeve wall being axially flexible;

a first flange having a central aperture, said first flange airtightly secured to the first and second sleeves sealing the annulus formed between the first and second sleeves, the central aperture of the first flange being aligned with the first sleeve open end, siad first sleeve, second sleeve and first flange, airtightly sealing said cryostat opening; and a second flange having a central opening adjustably airtightly secured in the central aperture of the first flange, said second flange adapted to be secured to said cryocooler when the cryocooler cold end is situated in said first sleeve such that evacuation of the cryostat and said first sleeve exerts pressure between the second stage of the cryocooler and the bottom of the first sleeve, and moving the first flange toward the second flange elongates the axial flexible portion of the first sleeve, increasing the force between the first stage heat station contact means and the first stage of the cryocooler.

2. The magnet of claim 1 wherein the axially flexible portion of the first sleeve and said second sleeve wall each comprises stainless steel cylindrical bellows.

3. The magnet of claim 1 further comprising means for limiting the axial travel of said first flange towards said cryostat when the cryocooler is not in said first sleeve, siad means situated between said cryostat and said first flange.

* * * * *